US011304576B2

(12) United States Patent
Jeong et al.

(10) Patent No.: US 11,304,576 B2
(45) Date of Patent: Apr. 19, 2022

(54) ROBOT CLEANER, STATION AND CLEANING SYSTEM

(71) Applicant: Samsung Electronics Co., Ltd., Suwon-si (KR)

(72) Inventors: Jae Youl Jeong, Suwon-si (KR); Sin-Ae Kim, Suwon-si (KR); Woo Jin Na, Suwon-si (KR); Hyoun Soo Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 195 days.

(21) Appl. No.: 16/707,491

(22) Filed: Dec. 9, 2019

(65) Prior Publication Data

US 2020/0187736 A1 Jun. 18, 2020

(30) Foreign Application Priority Data

Dec. 14, 2018 (KR) ..... 10-2018-0162112

(51) Int. Cl.

| | |
|---|---|
| ***A47L 9/10*** | (2006.01) |
| ***A47L 9/28*** | (2006.01) |
| *A47L 9/14* | (2006.01) |

(52) U.S. Cl.

CPC ..... *A47L 9/106* (2013.01); *A47L 9/2873* (2013.01); *A47L 9/1409* (2013.01); *A47L 9/2884* (2013.01); *A47L 2201/022* (2013.01); *A47L 2201/024* (2013.01); *A47L 2201/04* (2013.01)

(58) Field of Classification Search

CPC ..... A47L 2201/022; A47L 2201/024; A47L 2201/04; A47L 9/106; A47L 9/1409; A47L 9/2873; A47L 9/2884

See application file for complete search history.

(56) References Cited

U.S. PATENT DOCUMENTS

| | | | | |
|---|---|---|---|---|
| 9,907,447 | B2 * | 3/2018 | Tanaka | A47L 9/2894 |
| 2005/0150519 | A1 * | 7/2005 | Keppler | A47L 9/2857 134/19 |

(Continued)

FOREIGN PATENT DOCUMENTS

| | | | | |
|---|---|---|---|---|
| CA | 2317598 | A1 * | 7/1999 | G05D 1/0225 |
| DE | 102010000607 | A1 * | 9/2011 | A47L 5/362 |

(Continued)

OTHER PUBLICATIONS

International Search Report dated Mar. 24, 2020, issued in an International Application No. PCT/KR2019/016544.

(Continued)

*Primary Examiner* — Marc Carlson

(74) *Attorney, Agent, or Firm* — Jefferson IP Law, LLP

(57) ABSTRACT

A cleaning system, including a robot cleaner and a station are provided. The cleaning system includes a robot cleaner including a dust collector, the dust collector provided with a dust outlet, and an outlet door configured to open and close the dust outlet. The robot cleaner further includes a station including a lever device configured to open the outlet door and communicate with the dust collector when the lever device is pressed by the robot cleaner, and a collector configured to communicate with the lever device, and generate a suction force to suction dust collected in the dust collector.

19 Claims, 10 Drawing Sheets

(56) References Cited

U.S. PATENT DOCUMENTS

| | | | | |
|---|---|---|---|---|
| 2005/0212478 | A1* | 9/2005 | Takenaka | A47L 9/2873 320/107 |
| 2007/0157416 | A1* | 7/2007 | Lee | A47L 9/2894 15/319 |
| 2007/0226949 | A1* | 10/2007 | Hahm | A47L 9/106 15/340.1 |
| 2007/0245511 | A1* | 10/2007 | Hahm | A47L 9/1691 15/319 |
| 2009/0049640 | A1* | 2/2009 | Lee | A47L 9/20 15/319 |
| 2012/0291809 | A1* | 11/2012 | Kuhe | A47L 11/33 134/18 |
| 2016/0278596 | A1* | 9/2016 | Janzen | A47L 11/4041 |
| 2017/0150861 | A1* | 6/2017 | Tanaka | A47L 9/2894 |
| 2017/0196430 | A1* | 7/2017 | Machida | A47L 9/106 |
| 2018/0029809 | A1* | 2/2018 | Lee | A47L 9/009 |
| 2019/0231160 | A1* | 8/2019 | Lu | A47L 11/4005 |
| 2020/0022553 | A1* | 1/2020 | Gill | A47L 11/4025 |
| 2020/0187736 | A1* | 6/2020 | Jeong | A47L 9/2873 |
| 2020/0229667 | A1* | 7/2020 | Yun | A47L 9/20 |
| 2020/0315419 | A1* | 10/2020 | Sato | A47L 5/36 |
| 2021/0045600 | A1* | 2/2021 | Schmitz | A47L 9/2873 |

FOREIGN PATENT DOCUMENTS

| | | | | |
|---|---|---|---|---|
| DE | 102010061327 | A1 * | 6/2012 | A47L 9/2884 |
| EP | 1961358 | A2 * | 8/2008 | A47L 9/106 |
| EP | 3033982 | A1 * | 6/2016 | A47L 9/20 |
| EP | 3 165 147 | A1 | 5/2017 | |
| KR | 10-2007-0099763 | A | 10/2007 | |
| KR | 10-0765208 | B1 | 10/2007 | |
| KR | 10-2013-0025320 | A | 3/2013 | |
| KR | 10-1496913 | B1 | 3/2015 | |
| KR | 10-1648880 | A | 8/2016 | |
| KR | 10-2017-0010402 | A | 1/2017 | |
| WO | WO-2007137234 | A2 * | 11/2007 | A47L 11/4025 |
| WO | WO-2017047291 | A1 * | 3/2017 | A47L 9/1691 |
| WO | 2018/107465 | A1 | 6/2018 | |
| WO | WO-2018100773 | A1 * | 6/2018 | A47L 9/242 |

OTHER PUBLICATIONS

European Search Report dated Oct. 21, 2021; European Appln. No. 19894798.8-1016 / 3860417 PCT/KR2019016544.

* cited by examiner

ROBOT CLEANER, STATION AND CLEANING SYSTEM

CROSS-REFERENCE TO RELATED APPLICATION(S)

This application is based on and claims priority under 35 U.S.C. § 119 of a Korean patent application number 10-2018-0162112, filed on Dec. 14, 2018, in the Korean Intellectual Property Office, the disclosure of which is incorporated by reference herein in its entirety.

BACKGROUND

1. Field

The disclosure relates to a robot cleaner, a station and a cleaning system. More particularly, the disclosure relates to a robot cleaner including a dust collector, a station including a collector and a cleaning system having the same.

2. Description of Related Art

In general, a robot cleaner is a device for automatically cleaning a space, which is to be cleaned, by vacuuming dirt such as dust accumulated on the floor while traveling in the cleaning space, without a user's operation. The robot cleaner travels in the space to be cleaned and cleans the space to be cleaned.

The robot cleaner identifies the distance to obstacles such as furniture, office supplies, and walls installed in a cleaning area through a distance sensor, and cleans the cleaning area while changing directions by selectively driving left and right wheel motors of the robot cleaner.

The robot cleaner may clean the floor through a cleaning pad equipped with a wet cloth or a dry cloth, or the robot cleaner may clean the floor using a dust collector.

The robot cleaner configured to clean the floor using the dust collector may include a dust collecting chamber. Dust collected in the dust collecting chamber may be emptied manually by a user or automatically emptied by a collector provided at a station.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide a cleaning system capable of automatically emptying dust collected in a robot cleaner.

Another aspect of the disclosure is to provide a cleaning system capable of preventing dust from being tangled in a collecting flow path when a station collects the dust in a collector of a robot cleaner.

Another aspect of the disclosure is to provide a cleaning system capable of allowing a robot cleaner to communicate with a station using a relatively simple configuration.

Additional aspects will be set forth in part in the description which follows and, in part, will be obvious from the description, or may be learned by practice of the presented embodiments.

In accordance with an aspect of the disclosure, a cleaning system is provided. The cleaning system includes a robot cleaner including a dust collector, the dust collector including a dust outlet and an outlet door configured to open and close the dust outlet, and a station including a lever device configured to open the outlet door and communicate with the dust collector when the lever device is pressed by the robot cleaner, and a collector configured to communicate with the lever device and generate a suction force to suction dust collected in the dust collector.

The outlet door may be slidable about the dust collector.

The robot cleaner may include a door elastic member configured to apply an elastic force to the outlet door in a direction of closing the dust outlet.

The robot cleaner may include a cleaner inlet formed toward a surface to be cleaned, a cleaner suction device configured to generate a suction force for suctioning dust, and a cleaner outlet configured to discharge air introduced through the cleaner inlet.

The robot cleaner may further include a drum blade arranged on the cleaner inlet.

The station may include a cleaner seating portion on which the robot cleaner is mounted, and the lever device may include a lever having one end configured to be pressed by the robot cleaner, a lever support member configured rotatably support the lever, and a connection member arranged at the other end opposite to one end of the lever, the connection member configured to be connectable to the dust outlet.

When the robot cleaner is seated on the cleaner seating portion, the robot cleaner may be positioned to press the lever, and when the lever is pressed by the robot cleaner, the lever may be rotated and move the connection member toward a direction in which the connection member is connected to the dust outlet.

When the robot cleaner is seated on the cleaner seating portion, the connection member may slide along a surface on which the dust outlet of the dust collector is formed, and open the outlet door.

When the robot cleaner is seated on the cleaner seating portion, the connection member may protrude to the outside of the cleaner seating portion so as to be connected to the dust outlet, and when the robot cleaner is not seated on the cleaner seating portion, the lever may protrude from the outside of the cleaner seating portion.

The lever device may include a lever elastic member configured to apply an elastic force to the lever to allow one end of the lever to protrude from the cleaner seating portion.

The collector may include a station suction device configured to generate a suction force, a collection chamber in which dust suctioned from the robot cleaner is collected, and an extension member configured to connect the connection member to the collection chamber.

The extension member may include a stretching member provided to be stretchable.

The station may include a station outlet configured to discharge air suctioned by the station suction device.

The connection member may include a sealing member configured to seal the periphery of the dust outlet when the connection member is connected to the dust outlet.

The robot cleaner may include a battery mounting portion and a cleaner charging terminal electrically connected to the battery mounting portion, and the station may include a station charging terminal provided to be electrically connected to the cleaner charging terminal when the robot cleaner is seated on the cleaner seating portion.

In accordance with another aspect of the disclosure, a station is provided. The station includes a cleaner seating portion on which a robot cleaner is seated, a lever device arranged in the cleaner seating portion, the lever device configured to communicate with a dust collector provided in the robot cleaner when being pressed by the robot cleaner, and a collector configured to communicate with the lever device and generate a suction force to suction dust collected in the dust collector.

The lever device may include a sealing member configured to seal a portion in contact with the robot cleaner to communicate with the dust collector.

The lever device may include a lever having one end configured to be pressed by the robot cleaner, a lever support member configured to rotatably support the lever, a lever elastic member configured to elastically press the lever to a direction of protruding from the cleaner seating portion, and a connection member arranged at the other end opposite to one end of the lever, and configured to communicate with the dust collector.

In accordance with another aspect of the disclosure, a robot cleaner is provided. The robot cleaner includes a cleaner inlet formed toward a surface to be cleaned, a cleaner suction device configured to generate a suction force to suction dust, a dust collector in which dust is introduced through the cleaner inlet, is collected, the dust collector is provided with a dust outlet, and an outlet door configured to be slidable about the dust collector to open and close the dust outlet.

The robot cleaner may further include a door elastic member configured to apply an elastic force to the outlet door in a direction of closing the dust outlet.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent and from the following description taken in conjunction with the accompanying drawings, in which.

Throughout the drawings, like reference numerals will be understood to refer to like parts, components, and structures.

DETAILED DESCRIPTION

Figure 1:
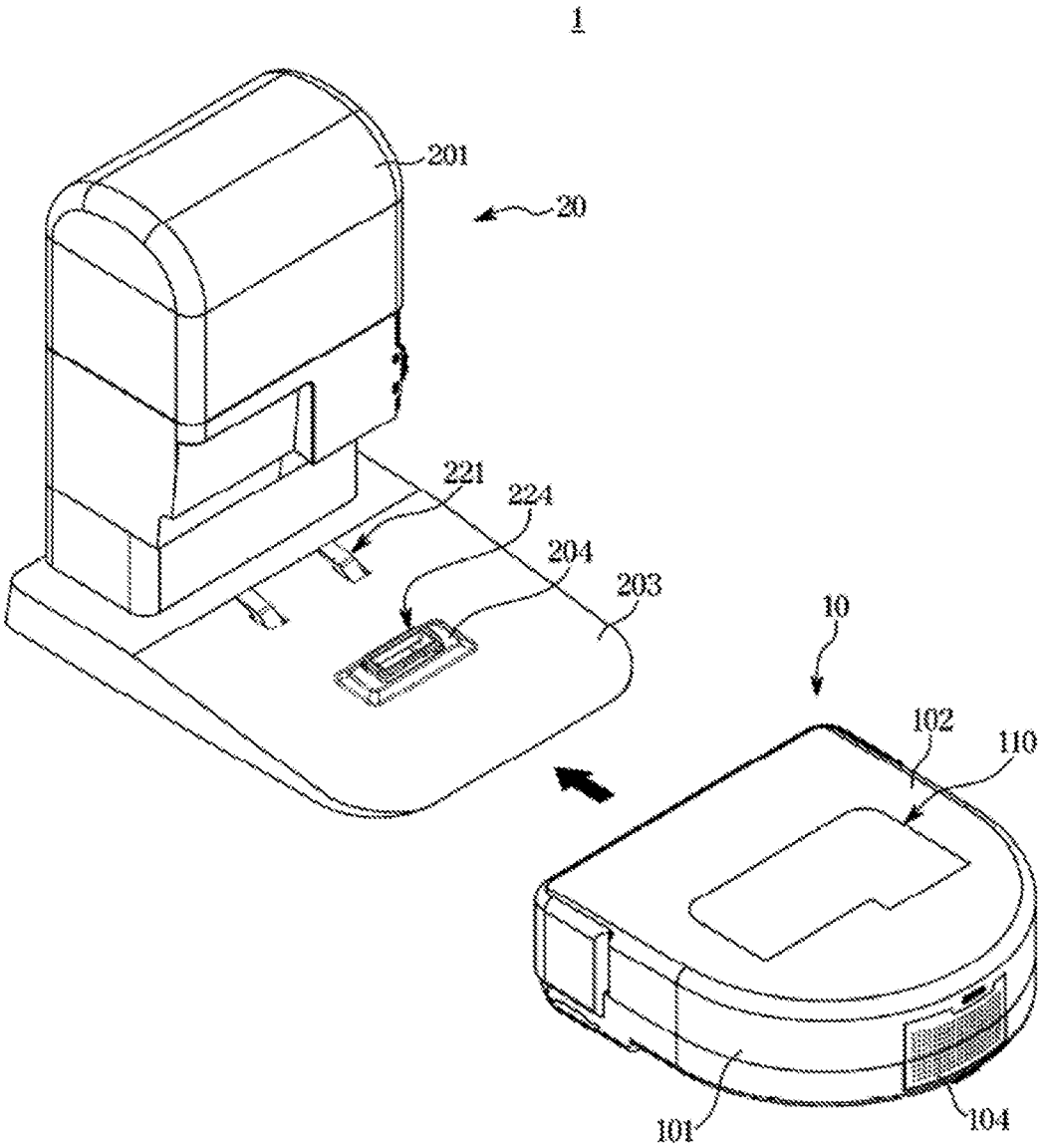
FIG. 1 is a view illustrating a state in which a robot cleaner of a cleaning system is separated from a station according to an embodiment of the disclosure.

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Embodiments described in the disclosure and configurations shown in the drawings are merely examples of the embodiments of the disclosure, and may be modified in various different ways at the time of filing of the disclosure to replace the embodiments and drawings of the disclosure.

In addition, the same reference numerals or signs shown in the drawings of the disclosure indicate elements or components performing substantially the same function.

Also, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

In the following detailed description, the terms of "upper side", "lower side", and "front-rear direction" may be defined by the drawings, but the shape and the location of the component is not limited by the term.

Particularly, as shown in FIG. 1, a moving direction of a robot cleaner 10 is defined as front, and based on this, rear, left and right side, and up and down side are defined.

The disclosure will be described more fully hereinafter with reference to the accompanying drawings FIG. 1 is a view illustrating a state in which a robot cleaner of a cleaning system is separated from a station according to an embodiment of the disclosure.

Figure 2:
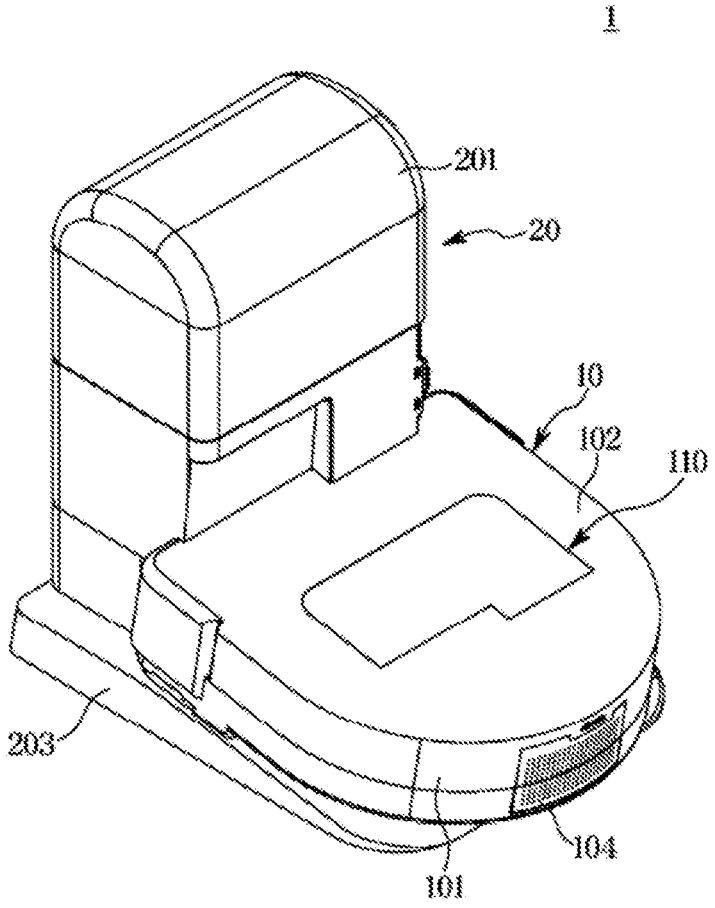
FIG. 2 is a view illustrating a state in which the robot cleaner of FIG. 1 is seated on the station according to an embodiment of the disclosure.

FIG. 2 is a view illustrating a state in which the robot cleaner of FIG. 1 is seated on the station according to an embodiment of the disclosure.

Referring to FIGS. 1 and 2, the cleaning system 1 may include a robot cleaner 10 and a station 20.

The robot cleaner 10 may clean a floor while moving along the floor. The floor cleaned by the robot cleaner 10 may be referred to as a surface to be cleaned. The robot cleaner 10 may move to the station 20 as shown in FIG. 2 when the robot cleaner needs to charge or when the robot cleaner needs to empty dust inside a dust collecting chamber 111 (refer to FIG. 6) because the dust collecting chamber 111 is fully filled with the dust.

The station 20 may be provided to allow the robot cleaner 10 to be mounted thereto. The station 20 may include a cleaner seating portion 203 on which the robot cleaner 10 is seated. When the robot cleaner 10 is seated, the station 20 may charge a battery 107 of the robot cleaner 10 or collect the collected dust in the dust collecting chamber 111 of the robot cleaner 10.

The cleaner seating portion 203 may have a connection opening 204 formed to allow a connection member 224 to protrude therefrom.

Figure 3:
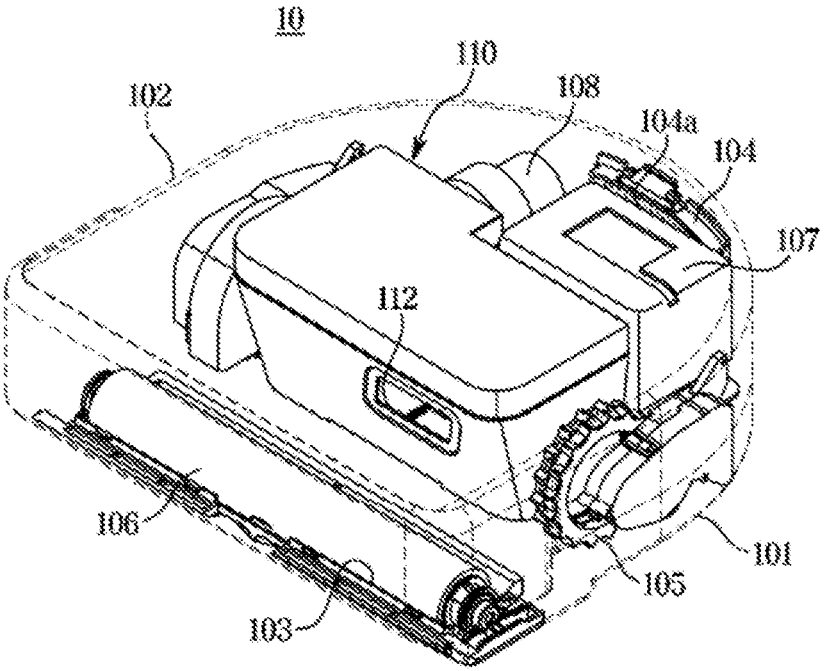
FIG. 3 is a view illustrating the inside of the robot cleaner of FIG. 1 according to an embodiment of the disclosure.

FIG. 3 is a view illustrating the inside of the robot cleaner of FIG. 1 according to an embodiment of the disclosure.

Figure 4:
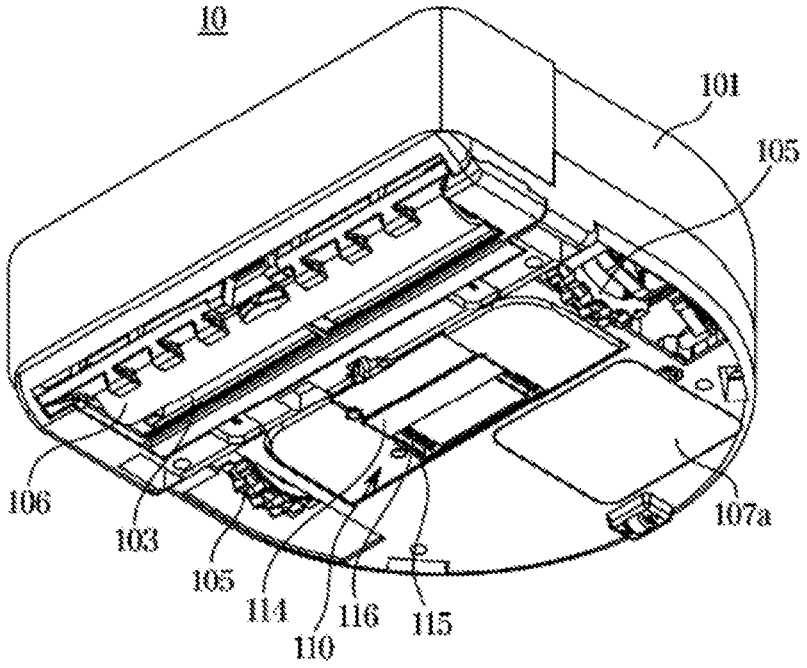
FIG. 4 is a view illustrating the bottom of the robot cleaner of FIG. 3 according to an embodiment of the disclosure.

FIG. 4 is a view illustrating the bottom of the robot cleaner of FIG. 3 according to an embodiment of the disclosure.

Figure 5:
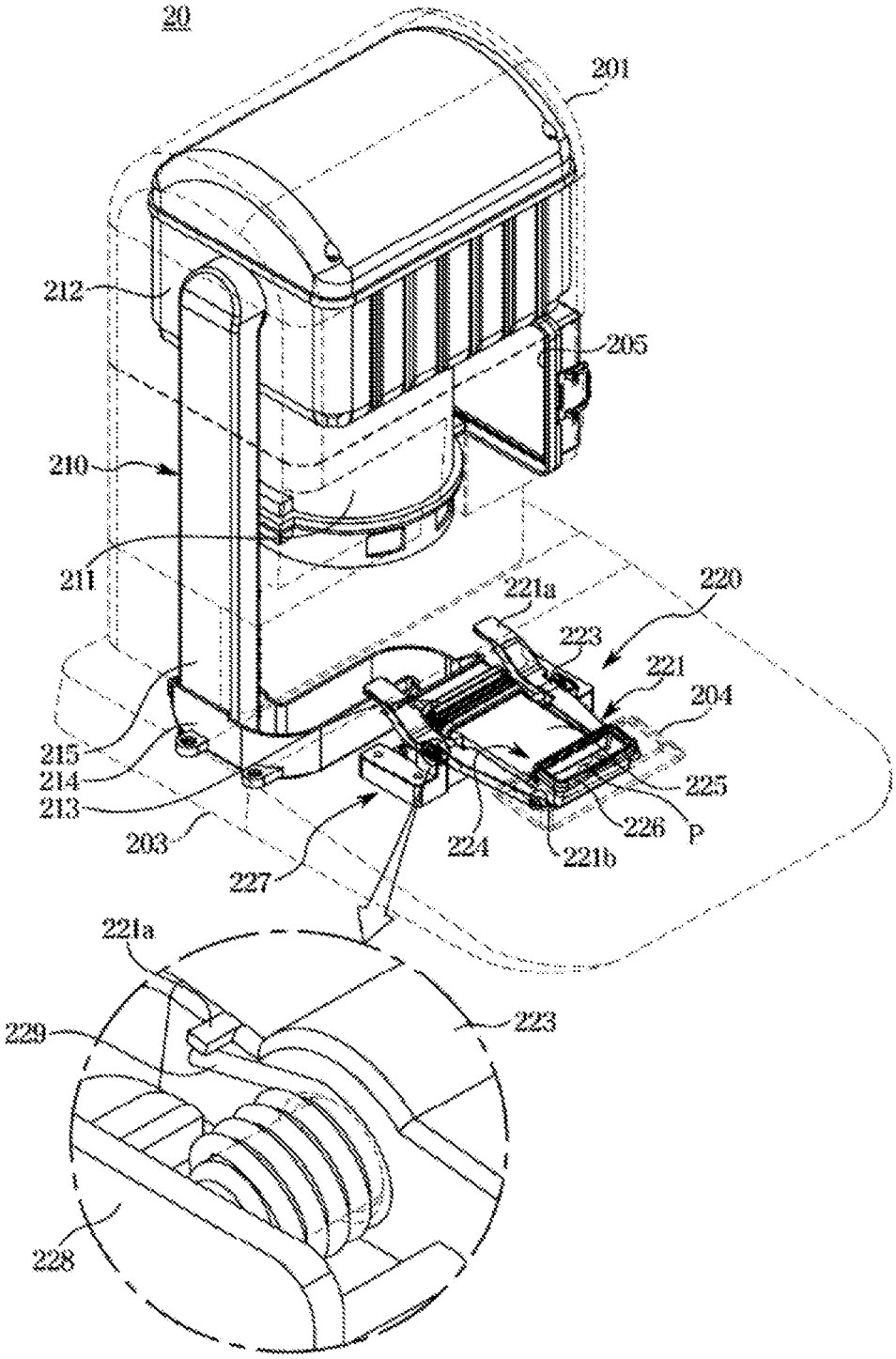
FIG. 5 is a view illustrating the inside of the station of FIG. 1 according to an embodiment of the disclosure.

FIG. 5 is a view illustrating the inside of the station of FIG. 1 according to an embodiment of the disclosure.

Figure 6:
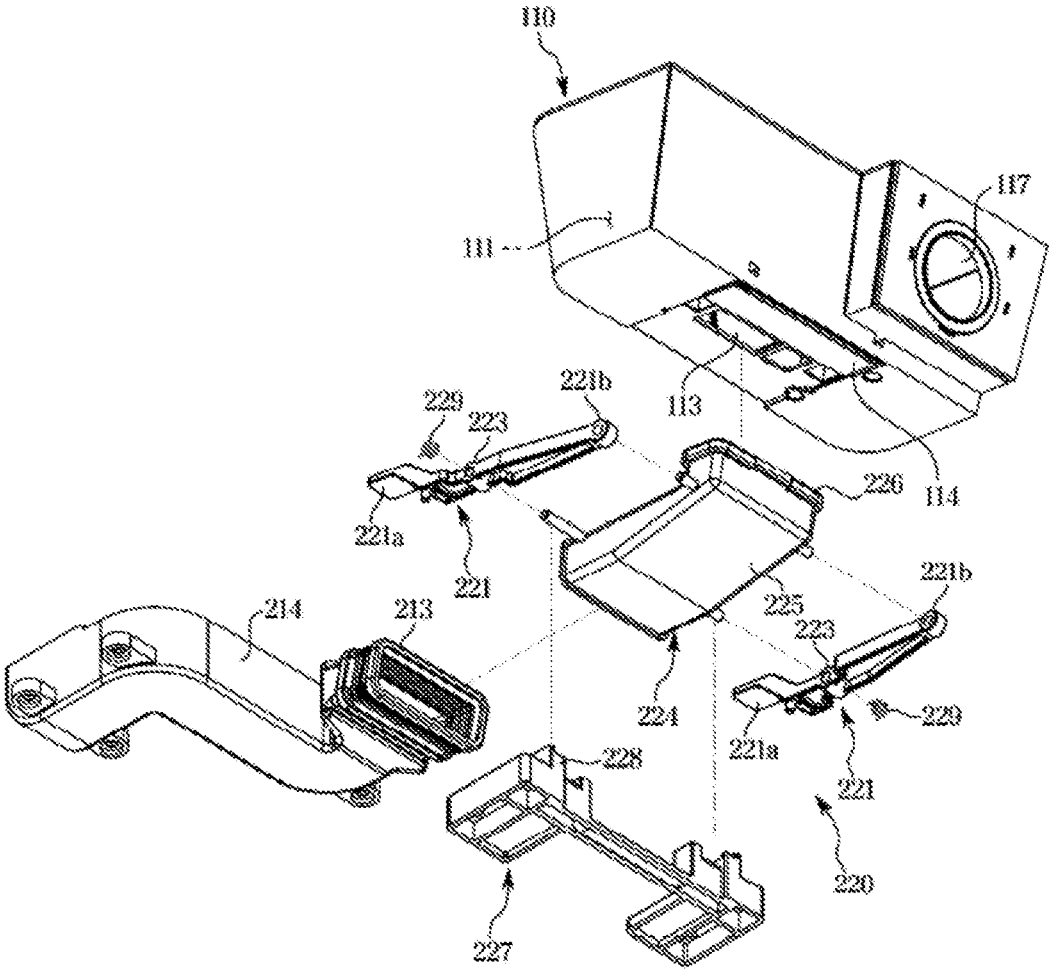
FIG. 6 is an exploded view illustrating a dust collector of FIG. 3 and a lever device of FIG. 5 according to an embodiment of the disclosure.

FIG. 6 is an exploded view illustrating a dust collector of FIG. 3 and a lever device of FIG. 5 according to an embodiment of the disclosure.

Referring to FIGS. 3 and 4, the robot cleaner 10 may include a cleaner housing 101 in which a receiving space is formed, and a cleaner cover 102 configured to cover an open upper surface of the cleaner housing 101. Electronic components may be arranged in the cleaner housing 101. The cleaner cover 102 may be removably coupled to the cleaner housing 101.

A cleaner inlet 103 may be formed in the cleaner housing 101. The cleaner inlet 103 may be formed toward the surface to be cleaned. The cleaner inlet 103 may be formed by passing through the bottom surface of the cleaner housing 101. Together with air, dust on the surface to be cleaned may be introduced into the dust collector 110 through the cleaner inlet 103.

A drum blade 106 may be arranged at the cleaner inlet 103. The drum blade 106 may be rotatably mounted about the cleaner housing 101. The drum blade 106 may hit the surface to be cleaned to scatter dust. Scattered dust may be introduced into the cleaner inlet 103 together with the ambient air.

Dust and/or air introduced through the cleaner inlet 103 may move to the dust collector 110. The dust and/or air may move to the dust collecting chamber 111 through a dust inlet 112.

The cleaner housing 101 may be provided with a cleaner outlet portion 104. The cleaner outlet portion 104 may be arranged on the rear side of the robot cleaner 10. The cleaner outlet portion 104 may discharge the air introduced through the cleaner inlet 103 to the outside of the robot cleaner 10 by a suction force generated by a cleaner suction device 108. The cleaner outlet portion 104 may include a cleaner outlet 104*a* provided with a plurality of through holes.

The robot cleaner 10 may include a cleaner wheel 105. The cleaner wheel 105 may move the robot cleaner 10. The cleaner wheel 105 may be rotated by receiving power from a wheel driving device (not shown). Although the cleaner wheel 105 is illustrated as being provided on the left side and the right side of the robot cleaner 10, the arrangement position of the cleaner wheel 105 is not limited thereto.

The robot cleaner 10 may include the battery 107. The battery 107 may be configured to be rechargeable. The battery 107 may provide power required for driving the robot cleaner 10.

A battery cover 107*a* may be removably mounted on the bottom surface of the cleaner housing 101. As the battery cover 107*a* is separated from the cleaner housing 101, the battery 107 may be separated from the robot cleaner 10.

The robot cleaner 10 may include the cleaner suction device 108. The cleaner suction device 108 may be provided as a fan motor device. The cleaner suction device 108 may generate a suction force for suctioning dust and/or air on the surface to be cleaned through the cleaner inlet 103. The cleaner suction device 108 may be arranged to communicate with an air outlet 117 of the dust collector 110. The cleaner suction device 108 may be arranged on an air flow path between the cleaner inlet 103 and the cleaner outlet portion 104.

Referring to FIGS. 3, 4 and 6, the dust collector 110 may be configured to filter out dust introduced through the cleaner inlet 103 and collect the filtered out dust. The dust collector 110 may include the dust collecting chamber 111 in which dust is collected, the dust inlet 112 through which dust and/or air is introduced, a dust outlet 113 through which dust is discharged to the station 20, an outlet door 114 configured to open and close the dust outlet 113, a door guide 115 to which the outlet door 114 is inserted in a slide manner, a door elastic member 116 configured to apply an elastic force to the outlet door 114, and the air outlet 117 through which air is discharged.

The dust collecting chamber 111 may collect the dust separated from the air containing the dust suctioned by the robot cleaner 10. The dust collecting chamber 111 may communicate with the outside through the dust outlet 113. In the dust collecting chamber 111, a device configured to separate dust from air may be arranged. A cyclone unit (not shown) may be arranged in the dust collecting chamber 111.

The dust outlet 113 may be opened and closed by the outlet door 114. The dust outlet 113 may be formed on the bottom surface of the dust collecting chamber 111. The dust outlet 113 may selectively communicate with a connecting member 224 of the station 20.

The outlet door 114 may open and close the dust outlet 113 while sliding with respect to the dust collector 110. The outlet door 114 may be slidably mounted to the door guide 115 formed at the bottom of the dust collector 110.

By the door elastic member 116, the outlet door 114 may be elastically biased in a direction of closing the dust outlet 113. That is, the door elastic member 116 may be configured to press the outlet door 114 in the direction of closing the outlet door 114.

The air outlet 117 may communicate with the cleaner suction device 108. That is, in the dust collector 110, the air, from which the dust is removed, may move to the cleaner outlet portion 114 after passing through the air outlet 117 by the suction force of the cleaner suction device 108.

Referring to FIG. 5, the station 20 may include a station housing 201 in which an accommodation space is formed, and a cleaner seating portion 203 in which the robot cleaner 10 is mounted.

At least a part of the collector 210 configured to collect dust collected in the dust collecting chamber 111 of the robot cleaner 10 may be arranged in the station housing 201. In the station housing 201, electronic components for charging the battery 107 of the robot cleaner 10 may be arranged.

A station outlet 205 may be formed in station housing 201. The station outlet 205 may be provided so that the station suction device 211 discharges the air suctioned from the dust collecting chamber 111 of the robot cleaner 10 to the outside of the station 20.

The cleaner seating portion 203 may be provided to allow the robot cleaner 10 to be seated thereon. The cleaner seating portion 203 may support the lower part of the station housing 201. A lever device 220 may be arranged on the cleaner seating portion 203.

The collector 210 may be configured to collect the collected dust in the dust collecting chamber 111 when the lever device 220 communicates with the dust collecting chamber 111 of the robot cleaner 10. The collector 210 may include a station suction device 211, a collection chamber 212, and extension members 213, 214, and 215.

The station suction device 211 may generate a suction force to suction dust from the dust collecting chamber 111 when the robot cleaner 10 is seated on the station 20, that is, when the dust collecting chamber 111 communicates with the lever device 220. The station suction device 211 may suction dust and/or air from the dust collecting chamber 111 of the robot cleaner 10, collect the dust in the collection chamber 212, and discharge the air to the outside of the station 20 through the station outlet 205.

The collection chamber 212 may filter out dust from dust and/or air, which is introduced into the inside of the station 20 by the station suction device 211, and collect the filtered out dust. A device (not shown) configured to filter out dust from dust and/or air, which is introduced through the extension members 213, 214, and 215 may be provided in the collection chamber 212.

The extension members 213, 214, and 215 may include the stretching member 213, the guide tube 214, and the extension tube 215.

The stretching member 213 may be connected to an end of the connection member 224. The stretching member 213 may communicate with the connection member 224. The stretching member 213 may include a material having the elasticity. The stretching member 213 may be stretched as the connection member 224 is moved. That is, the stretching member 213 may expand when the connection member 224 moves in the direction in communication with the dust collecting chamber 111, and may contract when the connection member 224 moves so as not to communicate with the dust collecting chamber 111. The stretching member 213 may have a bellows shape. The stretching member 213 may guide the dust and/or air, which is introduced through the connection member 224, to the guide tube 214.

The guide tube 214 may extend to the extension tube 215 by being connected to the stretching member 213. The guide tube 214 may guide dust and/or air introduced from the stretching member 213 to the extension tube 215.

The extension tube 215 may connect the guide tube 214 to the collection chamber 212. The extension tube 215 may guide dust and/or air introduced through the guide tube 214 to the collection chamber 212. At least one part of the extension tube 215 may extend in the vertical direction.

The lever device 220 may be configured to allow the collector 210 to selectively communicate with the dust collecting chamber 111 of the robot cleaner 10. When the lever device 220 is pressed by the load of the robot cleaner 10, the lever device 220 may open the outlet door 114 and allow the dust collecting chamber 111 to communicate with the collector 210. The lever device 220 may include a lever 221, the connection member 224, and a lever support member 227.

The lever 221 may be rotatable about the cleaner seating portion 203. The lever 221 may be rotatably coupled to the lever support member 227. The lever 221 may include a rotation support 223 rotatably coupled to the lever support member 227. The lever 221 may be provided in such a way that one end 221*a* is pressed by the robot cleaner 10 when the robot cleaner 10 is seated on the cleaner seating portion 203.

The lever device 220 may include a lever elastic member 229 configured to elastically bias the one end 221*a* of the lever 221 in a direction protruding from the cleaner seating portion 203. When the one end 221*a* of the lever 221 is not pressed by the robot cleaner 10, the one end 221*a* may protrude from the cleaner seating portion 203 by the lever elastic member 229.

The lever 221 may include a lever protrusion 221*a* receiving an elastic force from the lever elastic member 229. The lever protrusion 221*a* may be in contact with an end of the lever elastic member 229.

The connection member 224 may be arranged at the other end 221*b* opposite to the one end 221*a* of the lever 221. The other end 221*b* of the lever 221 may support the connection member 224.

Referring to FIGS. 5 and 6, the figures illustrate that the levers 221 are provided in pairs on the left and right sides of the connection member 224, but the number of the levers 221 is not limited thereto.

The connection member 224 may be configured to allow the extension members 213, 214, and 215 to selectively communicate with the dust collecting chamber 111 of the robot cleaner 10. The connection member 224 may include a connection tube 225 rotatably coupled to the lever support member 227 together with the rotation support 223 of the lever 221. The connection member 224 may form a collecting flow path P therein. The connection member 224 may protrude from the cleaner seating portion 203 when the lever 211 is pressed by the robot cleaner 10, and the connection member 224 may be inserted into the inside of the connection opening 204 of the cleaner seating portion 203 so as not to protrude from the cleaner seating portion 203 when the robot cleaner 10 is not placed at the cleaner seating portion 203.

The connection tube 225 may be rotated with the lever 221 about the lever support member 227. That is, when the lever 221 is rotated by being pressed by the robot cleaner 10, the connection tube 225 may also be rotated in the same direction as the lever 221. The connection tube 225 may be connected to the stretching member 213.

A sealing member 226 may be provided at one end of the connection tube 225 communicating with the dust collecting chamber 111 of the robot cleaner 10. The sealing member 226 may extend along an end in contact with the dust collector 110 of the connection tube 225. The sealing member 226 may extend along the periphery of the dust outlet 113 when the connection member 224 is in contact with the dust collector 110. The sealing member 226 may seal between the connection tube 225 and the bottom surface of the dust collector 110. The sealing member 226 may include a material having the elasticity.

The lever support member 227 may be fixed to the cleaner seating portion 203. The lever support member 227 may rotatably support the lever 221 and the connection member 224. The lever support member 227 may include a rotation coupler 228 to which the lever 221 and the connection member 224 are rotatably coupled. The other end of the lever elastic member 229, which is opposite to the one end of the lever elastic member 229 in contact with the lever 221 may be fixed to the rotation coupler 228.

Figure 7:
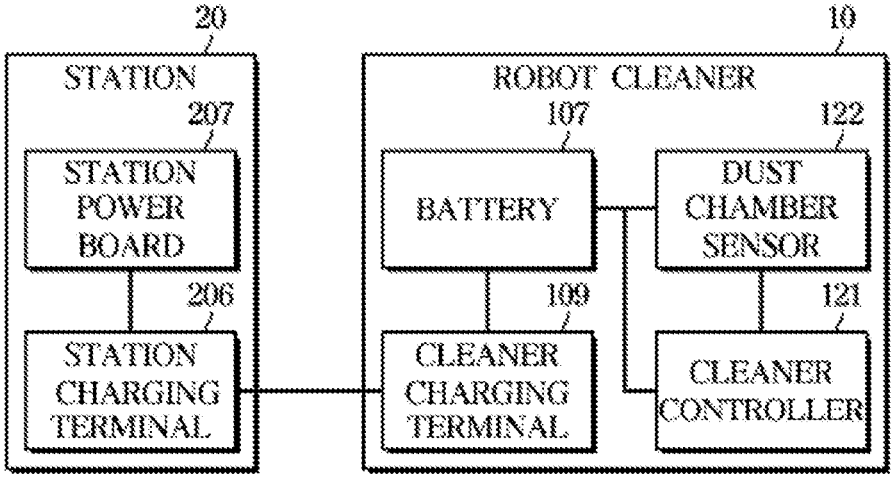
FIG. 7 is a diagram illustrating an electrical connection relationship between the robot cleaner and the station of FIG. 1 according to an embodiment of the disclosure.

FIG. 7 is a diagram illustrating an electrical connection relationship between the robot cleaner and the station of FIG. 1 according to an embodiment of the disclosure.

Referring to FIG. 7, the robot cleaner 10 may include a cleaner charging terminal 109 electrically connected to the battery 107 when the battery 107 is mounted.

The station 20 may include a station charging terminal 206 electrically connected to the cleaner charging terminal 109 to charge the battery 107 of the robot cleaner 10, and a station power board 207 electrically connected to the station charging terminal 206 to receive power from the outside.

Using this configuration, it is possible to charge the battery 107 when the robot cleaner 10 is seated on the station 20.

The robot cleaner 10 may include a dust chamber sensor 122 provided to measure an amount of dust collected in the dust collecting chamber 111. The dust chamber sensor 122 may be provided as an infrared sensor. The dust chamber sensor 122 may transmit information to a cleaner controller 121 when the dust chamber sensor 122 detects that dust collected in the dust collecting chamber 111 reaches a predetermined amount, and the cleaner controller 121 may control the robot cleaner 10 to move to the station 20 based on the information received from the dust chamber sensor 122.

Figure 8:
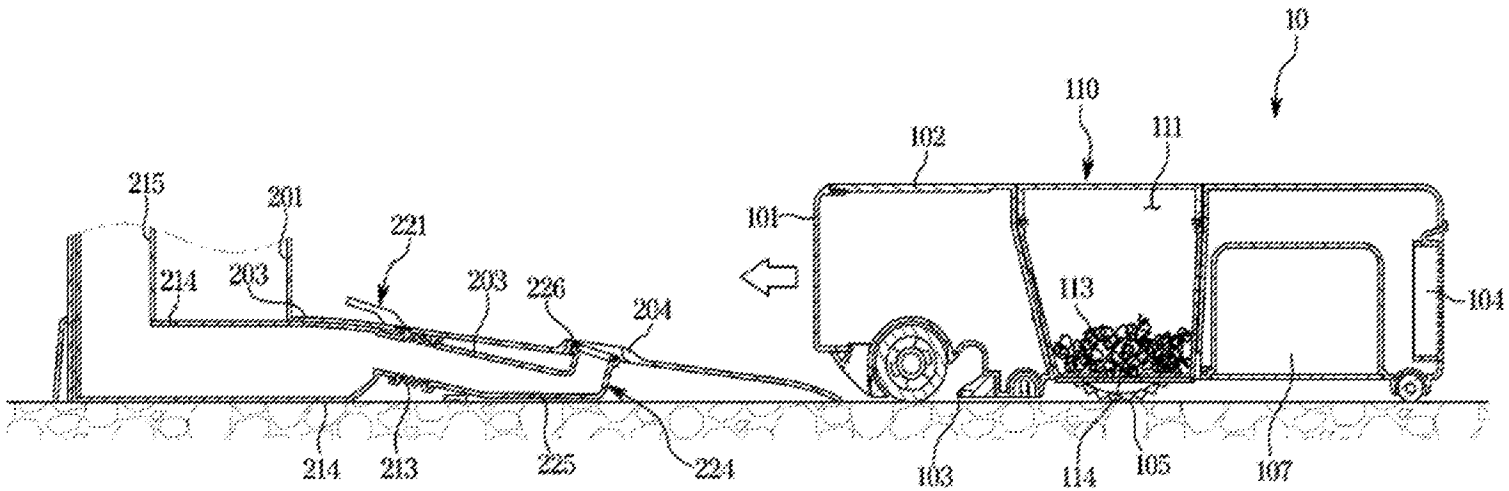
FIGS. 8, 9, and 10 are views illustrating a process in which the robot cleaner of FIG. 1 moves to the station and empties dust collected in a dust collecting chamber according to various embodiments of the disclosure.
Figure 9:
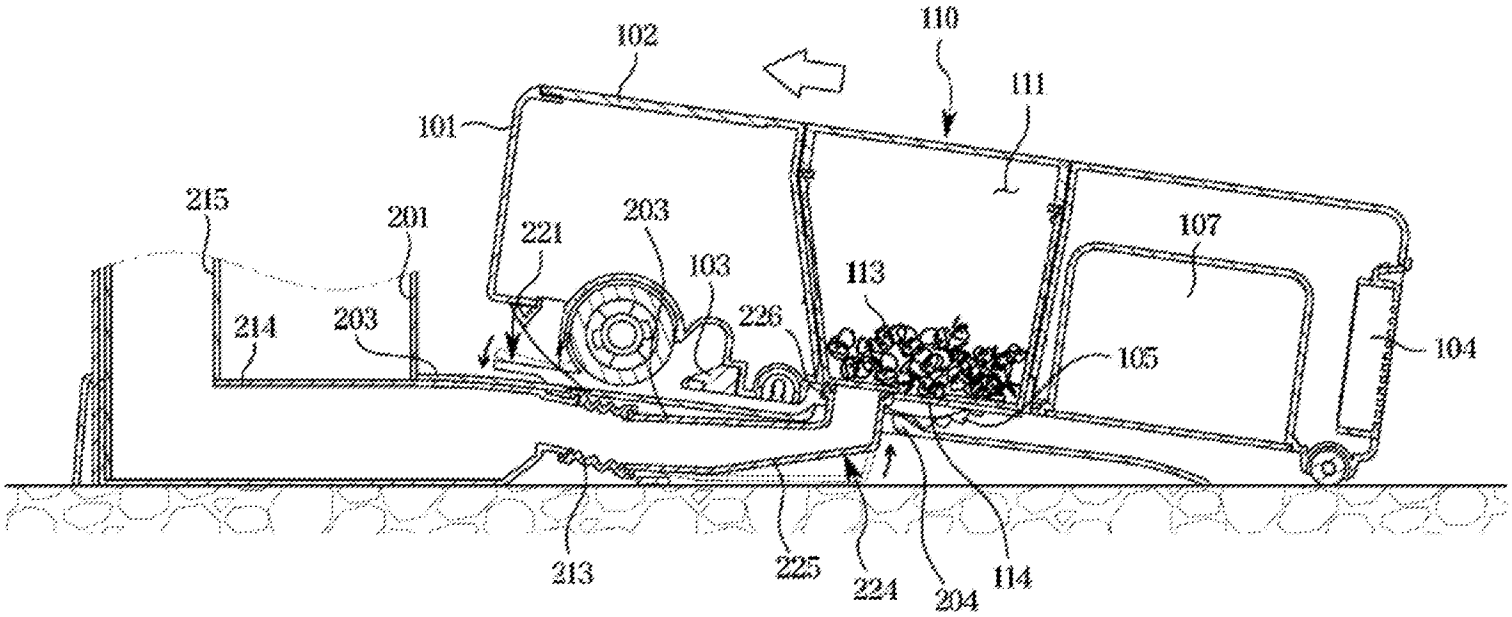
Figure 10:
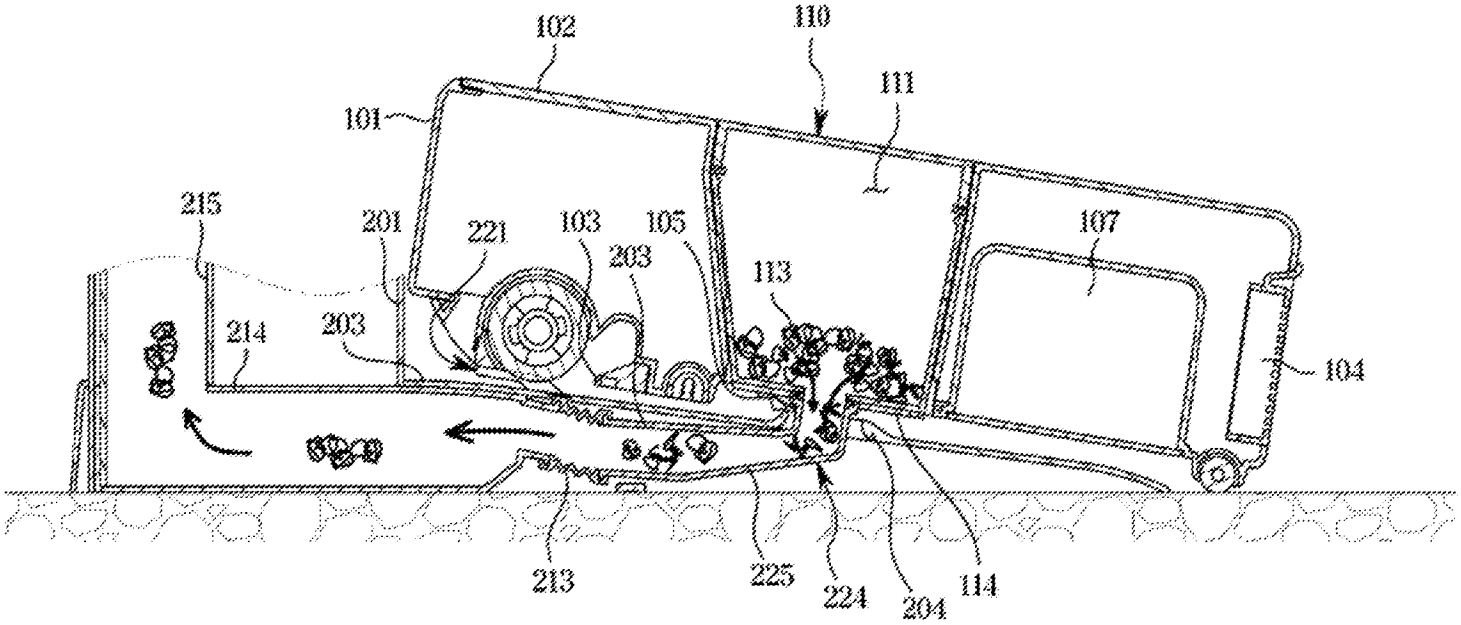

FIGS. 8 to 10 are views illustrating a process in which the robot cleaner of FIG. 1 moves to the station and empties dust collected in a dust collecting chamber according to various embodiments of the disclosure.

Referring to FIG. 8, when the dust chamber sensor 122 detects that the dust collected in the dust collecting chamber 111 has exceeded the predetermined amount, the dust chamber sensor 122 may transmit a signal to the cleaner controller 121. The cleaner controller 121 may control the cleaner wheel 105 to move the robot cleaner 10 to the station 20.

Referring to FIG. 9, the robot cleaner 10 may move to the cleaner seating portion 203. The robot cleaner 10 may move to a portion where the lever 221 of the cleaner seating portion 203 protrudes. The robot cleaner 10 may move inward of the cleaner seating portion 203 and then press the one end 221*a* of the lever 221. As the robot cleaner 10 presses the protruding one end 221*a* of the lever 221, the lever 221 may be rotated about the lever support member 227. As the lever 221 is rotated, the connection member 224 also may be rotated. The connection member 224 is rotated in such a way that one end in which sealing member 226 is arranged is rotated to a direction in contact with the robot cleaner 10. As for the connection member 224, the other end opposite to one end connected to the stretching member 213 is in contact with the bottom surface of the dust collector 110.

Referring to FIG. 10, while the connection member 224 is in contact with the dust collector 110, the robot cleaner 10 may move further into the cleaner seating portion 203. Accordingly, one end of the connection member 224, in which the sealing member 226 is arranged, is slidably moved with respect to the bottom surface of the dust collector 110. That is, the connection member 224 may be slid about the robot cleaner 10 along the surface on which the dust outlet 113 of the dust collecting device 110 is formed. In addition, a portion of the connection member 224 in contact with the dust collector 110 may press the outlet door 114 closing the dust outlet 113 to move the outlet door 114 toward the direction of opening the dust outlet 113.

As the outlet door 114 moves in the direction opposite to the moving direction of the robot cleaner 10 and opens the dust outlet 113, the dust collecting chamber 111 is in communication with the collecting flow path P. The door elastic member 116 is in a contracted state as the outlet door 114 opens the dust outlet 113.

The station 20 may drive the station suction device 211 when the lever 211 is rotated by the load of the robot cleaner 10. Therefore, the suction force from the lever device 220 toward the collector 210 is generated in the collecting flow path P.

Accordingly, the dust collected in the dust collecting chamber 111 is moved to the collecting flow path P. That is, the dust collecting chamber 111 of the robot cleaner 10 is emptied.

The dust moved to the collecting flow path P moves to the extension members 213, 214, and 215 through the connection tube 225, and the dust passing through the extension members 213, 214, and 215 is collected in the collection chamber 212. The collection chamber 212 may be emptied by a user.

The air introduced through the collecting flow path P is introduced into the station suction device 211 through the collection chamber 212, passes through the station suction device 211, and then passes through the station outlet 205 of the station 20, thereby being discharged to the outside.

By using this configuration, the cleaning system 1 according to an embodiment of the disclosure may automatically process the dust collected in the robot cleaner 10 using a relatively simple configuration. In addition, the cleaning system 1 according to an embodiment of the disclosure may prevent the collected dust from being tangled because it is not placed on the collecting flow path P, that is, it is not placed on a route on which the dust is collected when the outlet door 114 opens and closes the dust outlet 113.

As is apparent from the above description, when the robot cleaner is seated on the station, the cleaning system may automatically communicate with the station so as to automatically empty dust collected in the robot cleaner.

The cleaning apparatus may prevent dust on the collecting flow path from being tangled because a separate structure is not arranged in the collecting flow path.

The cleaning apparatus may allow the robot cleaner to communicate with the station using a relatively simple configuration because the collector automatically communicates with the dust collector through the drive of the robot cleaner seated on the station.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. A cleaning system comprising:

a robot cleaner including:

a dust collector provided with a dust outlet, and an outlet door configured to open and close the dust outlet; and a station including:

a lever device configured to open the outlet door and communicate with the dust collector when the lever device is pressed by the robot cleaner, and a collector configured to:

communicate with the lever device, and generate a suction force to suction dust collected in the dust collector, wherein the station comprises a cleaner seating portion on which the robot cleaner is seated, wherein the lever device includes:

a lever having one end configured to be pressed by the robot cleaner, and a connection member arranged at the other end opposite to one end of the lever, the connection member configured to be connectable to the dust outlet, wherein, when the robot cleaner is seated on the cleaner seating portion, the robot cleaner is positioned to press the lever, and wherein, when the lever is pressed by the robot cleaner, the lever is rotated and moves the connection member toward a direction in which the connection member is connected to the dust outlet.

2. The cleaning system of claim 1, wherein the outlet door is slidable about the dust collector.

3. The cleaning system of claim 2, wherein the robot cleaner comprises a door elastic member configured to apply an elastic force to the outlet door in a direction of closing the dust outlet.

4. The cleaning system of claim 1, wherein the robot cleaner further includes:

a cleaner inlet formed toward a surface to be cleaned;

a cleaner suction device configured to generate a suction force to suction dust; and a cleaner outlet configured to discharge air introduced through the cleaner inlet.

5. The cleaning system of claim 4, wherein the robot cleaner further includes a drum blade arranged on the cleaner inlet.

6. The cleaning system of claim 1, wherein the lever device further includes:

a lever support member configured to rotatably support the lever.

7. The cleaning system of claim 1, wherein, when the robot cleaner is seated on the cleaner seating portion, the connection member slides along a surface on which the dust outlet of the dust collector is formed, and the connection member opens the outlet door.

8. The cleaning system of claim 1, wherein, when the robot cleaner is seated on the cleaner seating portion, the connection member protrudes to an outside of the cleaner seating portion so as to be connected to the dust outlet, and wherein, when the robot cleaner is not seated on the cleaner seating portion, the lever protrudes from the outside of the cleaner seating portion.

9. The cleaning system of claim 1, wherein the lever device comprises a lever elastic member configured to apply an elastic force to the lever to allow one end of the lever to protrude from the cleaner seating portion.

10. The cleaning system of claim 1, wherein the collector comprises:

a station suction device configured to generate a suction force;

a collection chamber in which dust suctioned from the robot cleaner is collected; and an extension member configured to connect the connection member to the collection chamber.

11. The cleaning system of claim 10, wherein the extension member comprises a stretching member provided to be stretchable.

12. The cleaning system of claim 10 wherein the station comprises a station outlet configured to discharge air suctioned by the station suction device.

13. The cleaning system of claim 1, wherein the connection member comprises a sealing member configured to seal a periphery of the dust outlet when the connection member is connected to the dust outlet.

14. The cleaning system of claim 1, wherein the robot cleaner comprises a battery mounting portion and a cleaner charging terminal electrically connected to the battery mounting portion, and wherein the station comprises a station charging terminal provided to be electrically connected to the cleaner charging terminal when the robot cleaner is seated on a cleaner seating portion.

15. A station comprising:

a cleaner seating portion on which a robot cleaner is seated;

a lever device arranged in the cleaner seating portion, the lever device configured to communicate with a dust collector provided in the robot cleaner when being pressed by the robot cleaner; and a collector configured to:

communicate with the lever device, and generate a suction force to suction dust collected in the dust collector, wherein the station comprises a cleaner seating portion on which the robot cleaner is seated, wherein the lever device includes:

a lever having one end configured to be pressed by the robot cleaner, and a connection member arranged at the other end opposite to one end of the lever, the connection member configured to be connectable to a dust outlet, wherein, when the robot cleaner is seated on the cleaner seating portion, the robot cleaner is positioned to press the lever, and wherein, when the lever is pressed by the robot cleaner, the lever is rotated and moves the connection member toward a direction in which the connection member is connected to the dust outlet.

16. The station of claim 15, wherein the lever device further comprises a sealing member configured to seal a portion in contact with the robot cleaner to communicate with the dust collector.

17. The station of claim 15, wherein the lever device further comprises:

a lever support member configured to rotatably support the lever; and a lever elastic member configured to elastically press the lever to a direction of protruding from the cleaner seating portion.

18. A robot cleaner comprising:

a cleaner inlet formed toward a surface to be cleaned;

a cleaner suction device configured to generate a suction force to suction dust;

a dust collector in which dust introduced through the cleaner inlet, is collected, the dust collector provided with a dust outlet; and an outlet door configured to be slidable about the dust collector to open and close the dust outlet, wherein a station comprises a cleaner seating portion on which the robot cleaner is seated, wherein a lever device includes:

a lever having one end configured to be pressed by the robot cleaner, and a connection member arranged at the other end opposite to one end of the lever, the connection member configured to be connectable to the dust outlet, wherein, when the robot cleaner is seated on the cleaner seating portion, the robot cleaner is positioned to press the lever, and wherein, when the lever is pressed by the robot cleaner, the lever is rotated and moves the connection member toward a direction in which the connection member is connected to the dust outlet.

19. The robot cleaner of claim 18, further comprising:

a door elastic member configured to apply an elastic force to the outlet door in a direction of closing the dust outlet.

* * * * *